United States Patent [19]

Oehmsen et al.

[11] 4,155,150

[45] May 22, 1979

[54] STRUCTURAL TRUSS ASSEMBLY AND METHOD

[75] Inventors: Erich Oehmsen, Valley Stream; Karl H. Oehmsen, Sayville, both of N.Y.

[73] Assignee: Oehmsen Plastic Greenhouse Mfg. Inc., Bohemia, N.Y.

[21] Appl. No.: 871,366

[22] Filed: Jan. 23, 1978

Related U.S. Application Data

[60] Continuation-in-part of Ser. No. 617,301, Oct. 6, 1975, abandoned, Division of Ser. No. 737,734, Nov. 1, 1976, Pat. No. 4,089,148.

[51] Int. Cl.[2] ..... B23P 17/00

[52] U.S. Cl. ..... 29/155 R; 29/526 A

[58] Field of Search ..... 29/155 R, 418, 423, 29/432, 437, 439, 514, 521, 526; 52/639, 641, 644, 645, 691, 693; 254/9 R, 122, 124; 74/521

[56] References Cited

U.S. PATENT DOCUMENTS

| | | | |
|---|---|---|---|
| 1,696,039 | 12/1928 | Kane | 52/693 |
| 2,171,673 | 9/1939 | Ropp | 52/693 |
| 3,019,491 | 2/1962 | Troutner | 52/474 |
| 3,541,749 | 11/1970 | Troutner | 52/693 |
| 3,826,057 | 7/1974 | Franklin | 52/693 X |
| 3,891,108 | 6/1975 | Traficant | 254/122 X |
| 4,077,176 | 3/1978 | Bauer | 52/693 |

*Primary Examiner*—Michael J. Keenan
*Attorney, Agent, or Firm*—Albert F. Kronman

[57] ABSTRACT

A structural truss composed of spaced rails interconnected by a series of struts swingably coupled at their ends. Track members on the rails receive the ends of the struts which are slid into place between the rails. Thereafter, the struts are crimped in place upon the rail members to form a load supporting structural member.

In a second embodiment, rivets are slipped into the track members, the struts are slipped upon the rivets and the end of the struts and the rivets are deformed to form the structural truss.

6 Claims, 11 Drawing Figures

FIG. 2
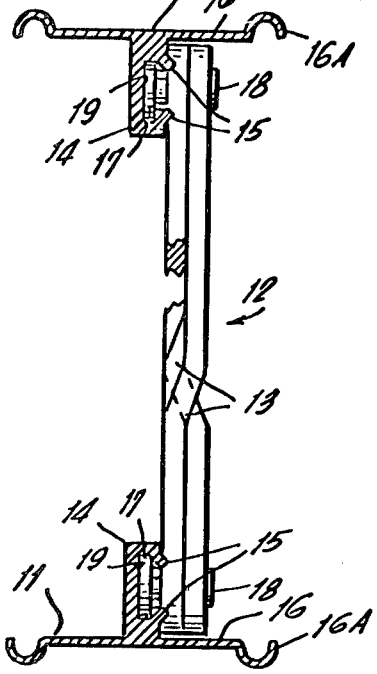
FIG. 1
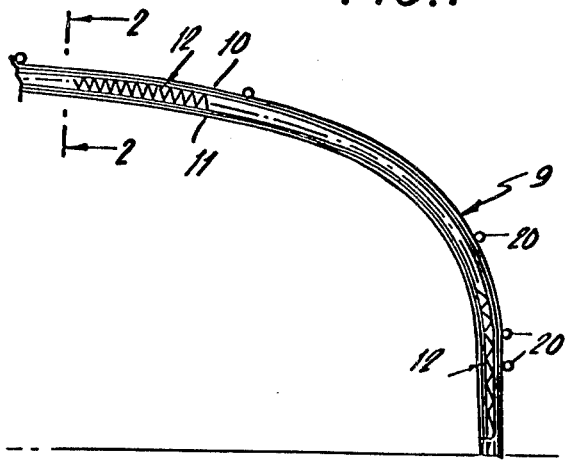
FIG. 3
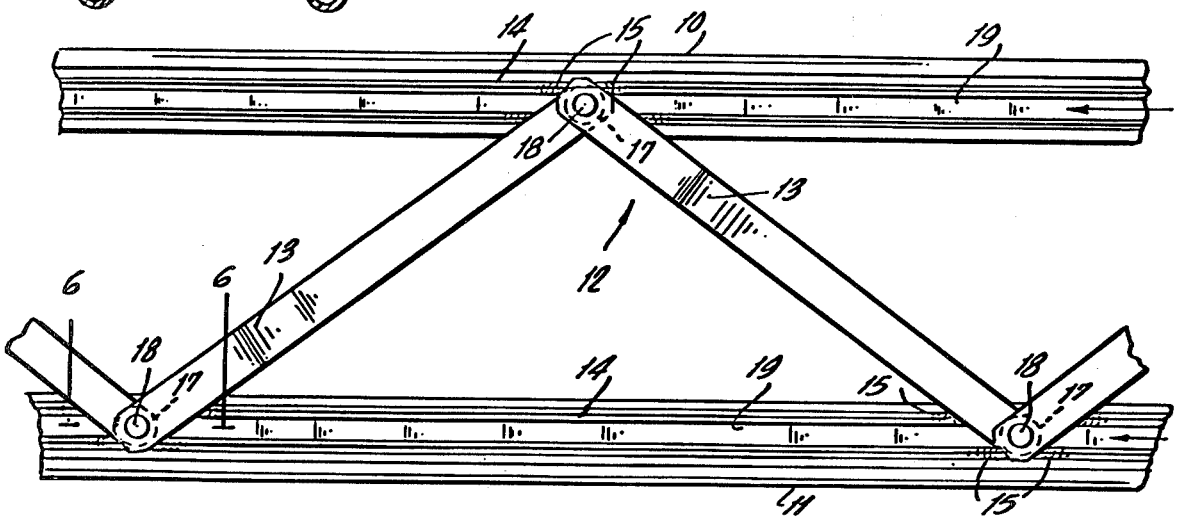
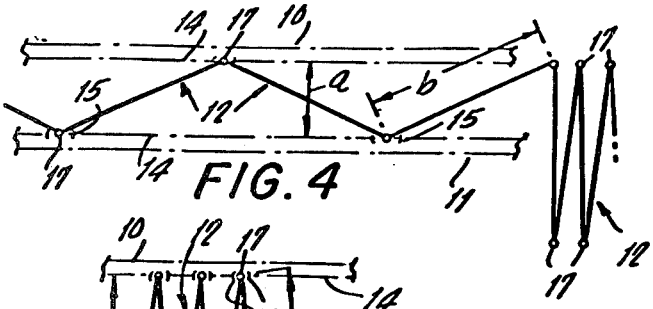
FIG. 4
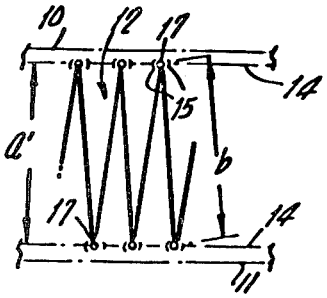
FIG. 5
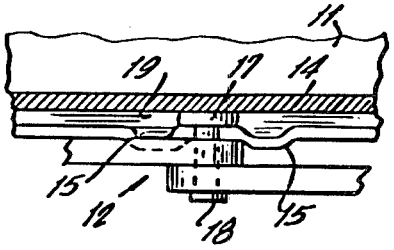
FIG. 6

STRUCTURAL TRUSS ASSEMBLY AND METHOD

RELATED APPLICATION

This application is a continuation-in-part of an application for United States Patent, Ser. No. 617,301 filed Oct. 6, 1975 by Erich Oehmsen entitled Structural Truss Assembly and Method, now abandoned and a Division of an application for U.S. Patent filed Nov. 1, 1976 Ser. No. 737,734, now U.S. Pat. No. 4,089,148, filed by Erich Oehmsen and Karl H. Oehmsen.

BACKGROUND OF THE INVENTION

This invention relates to structural trusses and the method of their assembly. It is well-known to form trusses which have spaced rails and rigid interconnected struts. Such trusses are generally made for specific installations and are fabricated from a large number of specialized parts which are welded or riveted together. These trusses are usually made at a distance from the building site and are transported as large bulky members. Often expensive fabricating facilities are built to avoid costly and inconvenient transportation of such trusses.

In the present invention, there is provided a structural truss which lends itself to ready assembly at the construction site using simple tools and jigs which are easily transported. The truss is suitable for a wide variety of uses and is made from preformed parts the struts of which are either of identical size and shape or of a very limited number of sizes.

SUMMARY

The invention consists of at least two rails having T-shaped cross sectional shapes. A track portion on each rail is disposed normal thereto. The track members are somewhat "C" shaped in cross section and receive therein the heads of a series of rivets. The struts are freely coupled together at their ends by the rivets. The rivets are provided with flat heads of a size that can be slid within the track openings and elongated shanks.

After the rails are bent to the desired configuration, the rivets of the struts are slipped into the tracks on each of the rails until the desired support is attained. (Usually when no more struts can be forced into the space between the rails). The struts are then secured in place by deforming the rail track to prevent longitudinal movement of the struts. The first and the last struts in the structure are secured to the track and the truss is then ready for use.

In another form of the invention, the rivets are first slipped into the tracks, the struts, which have rivet receiving openings at both ends thereof are placed upon the rivet shanks and the struts driven into the track structure to deform it and lock the assembly in place. The rivet shanks are then peened over upon the struts.

BRIEF DESCRIPTION OF THE FIGURES

In the accompanying drawings forming part hereof is shown two embodiments of the present invention in which drawings similar parts have been given identical reference numbers, and in which:

FIG. 1 is a somewhat diagrammatic view of a truss made in accordance with the present invention.

FIG. 2 is a cross sectional fragmentary view of the truss shown in FIG. 1 on an enlarged scale. The view is taken along the line 2—2 in FIG. 1 looking in the direction of the arrows.

FIG. 3 is a fragmentary view in side elevation of the truss.

FIGS. 4 and 5 are diagrammatic views showing the method of assembly of the truss.

FIG. 6 is a cross sectional view taken on line 6—6 of FIG. 3 looking in the direction of the arrows.

GENERAL DESCRIPTION

Figure 7:
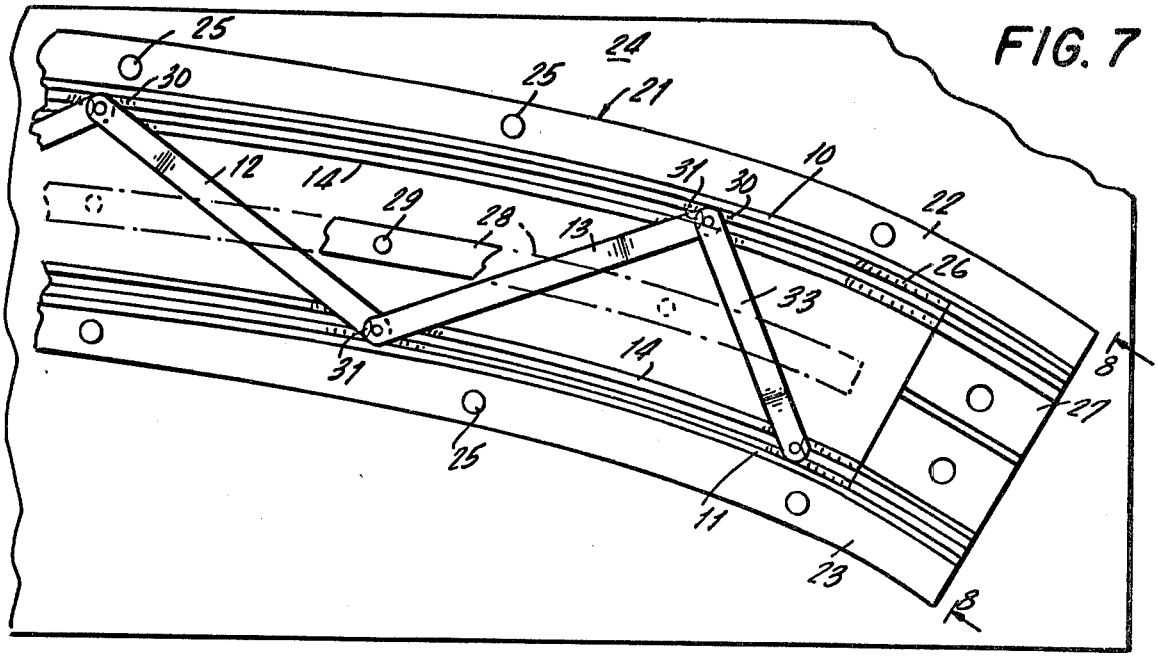
FIG. 7 is a fragmentary view in side elevation on an enlarged scale of the truss showing a second embodiment of the present invention.
Figure 8:
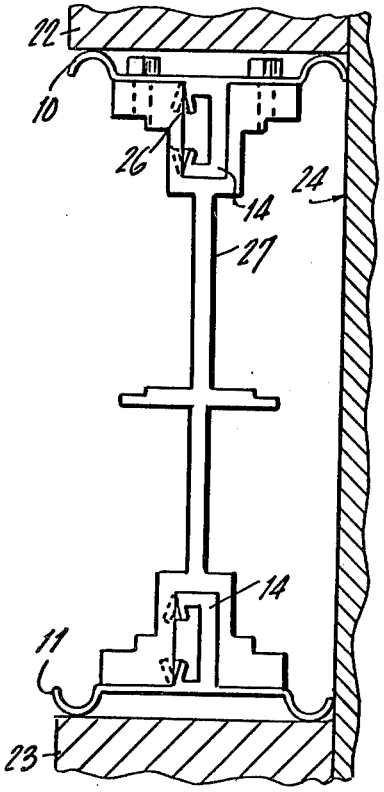
FIG. 8 is a cross sectional view taken on line 8—8 in FIG. 7.
Figure 9:
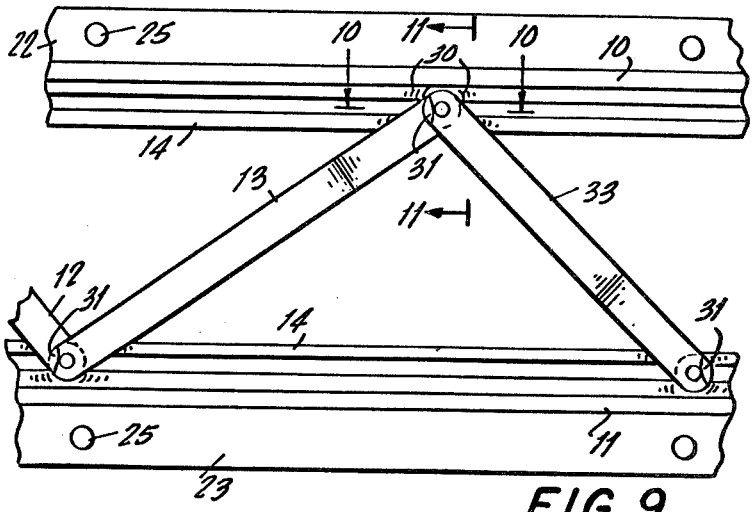
FIG. 9 is a view similar to FIG. 7 showing another step in the fabrication of the truss.

Referring to the drawing and specifically to FIGS. 1, 2, and 3, the truss 9 consists of two elongated "T" shaped rails 10, 11 spaced from each other and interconnected by a series of struts 12. Each rail consists of outwardly extending flanged portions 16 and a track 14 normally secured to the flanged portion 16. The flanged portion 16 may be reinforced by longitudinal ribs 16A of arcuate cross section integral with the margins of the flanged portions, as best shown in FIG. 2. While it is most convenient to form the rails and trusses of extruded aluminum, other rigid and semi-rigid materials such as steel, plastic etc. may be employed without departing from the spirit of the present invention.

The track 14 is formed with a somewhat "C" shaped cross-section to receive therein the heads 17 of rivets 18 as hereinafter more fully set forth.

A series of struts 12 having an elongated bar shaped configuration and swingably connected by rivets 18 completes the truss structure. The struts 12 are laterally offset as shown at 13 in order to prevent deflection of the assembly. The rivets 18 are provided with flatened heads 17 of a diameter which will permit them to freely slip between the opening 19 in the "C" shaped tracks 14 and elongated shanks 34.

In fabricating a truss according to the present invention, two rails are cut to length from the desired material. A series of identical struts 12 are next formed to their desired shape and bored at their ends to receive rivets 18. The struts are swingably coupled at their ends by means of the rivets 18 and the truss is then ready for assembly.

With the parts cut to size and the struts coupled together, all of the components may be either assembled to form the truss or shipped to the site where the truss is to be used and then assembled.

In assembling the truss the rails 10, 11 are first bent by means of jigs or formed into the desired shape such as the shape shown in FIG. 1. This shape may involve curvature of the rails to provide differences in separation throughout the length of the truss depending upon the structural requirements for which the truss is intended. With the rails 10, 11 held in their proper spaced position, the struts are next fed between the rails by sliding the rivet heads 18 along the track openings 19. It will be seen by FIGS. 4 and 5 that where the rails 10, 11 are relatively close together the angular disposition of the struts 12 therebetween will be greater than where the rails are further apart as shown in FIG. 5. Nevertheless, the length of the struts 12 indicated by arrow B in FIGS. 4 and 5 remains the same making it unnecessary to provide struts of different sizes to accomodate the different spacing between the rails along the length of the truss. When the spacing between the rails is completely filed by the struts in this manner, the struts are locked in place by means of a tool (not shown) which deforms the edges of the track 13 in the manner shown in FIG. 5 at 15. This deformation prevents the rivet heads 17 from moving because the deformed portion of the edge 15 of the track 14 blocks movement of the struts 12. The last strut at each end of the assembly is similary locked in place by a crimping tool and the truss is then complete and ready for use.

With the trusses in place, various well-known structural elements such as purlins 20 (shown in FIG. 1) may be secured to the truss. In addition, a series of trusses may be erected in spaced upright position to support a roof covering such as a plastic sheet or sheets of glass, metal, or the like.

Despite the lightweight construction, the above described truss has been found to be capable of supporting reasonable snow loads and serving as the main support member for light structures such as greenhouses, storage sheds and swimming pool enclosures.

Referring to FIGS. 7 through 11 there is shown a similar embodiment of the present invention in which a truss 21 is built of spaced rail members 10, 11 similar to those shown in FIGS. 1 through 6. The rails 10, 11 may be bent into a desired shape such as a curved shape shown in FIG. 1 by means of spaced forming dies 22, 23. The dies 22, 23 may be made of wood, steel, or any other material capable of retaining the rails in a bent configuration. The rails can be bent upon the dies or forced against the dies to produce the proper shape. The dies, 22, 23 are simple in construction and may be secured to a table by means of fasteners 25.

Figure 10:
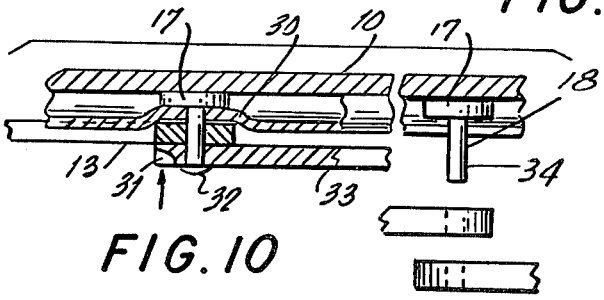
FIG. 10 is a sectional view taken on line 10—10 in FIG. 9.
Figure 11:
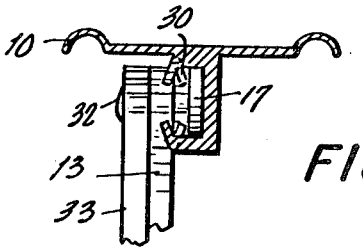
FIG. 11 is a cross sectional view taken on line 11—11 in FIG. 9.

With the device in position as shown in FIG. 7, a plurality of flat headed rivets 18 are slipped into the track members 14 with the shanks 34 of the rivets extending outwardly from the track 14 as shown in FIG. 10. When the desired number of rivets are in the track, a series of struts 12 identical in shape to those previously described are placed upon the assembly so that adjacent struts are received on a common rivet shank as shown in FIGS. 10 and 11. When the space between the rails 10, 11 has been taken up by the supporting struts the end of the assembly is closed by first peening the tracks 14 in the manner shown at 26 in FIG. 7 so as to deform the said tracks and permit an end block 27 to be slipped between the rails and upon the tracks 14. The peened portion of the tracks prevent the struts from moving longitudinally within the tracks 14. The end block 27 serves to support the free ends of the truss and also as a connecting member for other structural elements well-known in the art.

The struts 12 may be held against the surface of the tracks 14 by a median support 28 which is clamped over the struts by suitable fastening devices 29. The fastening devices 29 are preferably of a quick disconnect nature to facilitate inserting and removing the assembly.

With the parts in place as indicated above, an air gun or suitable hand held tool capable of applying a hammering force is brought into contact with each end of the struts 12 and sufficient force applied to drive the struts into the track material until the track material is deformed as indicated at 30 in FIG. 10. These struts will also be partly deformed at 31 in FIGS. 7 and 9. The deformation of the track in this manner locks the struts in place and adds to the rigidity of the assembled truss.

As a final operation, the same air gun or hammer is applied to the free ends of the rivets to peen the rivets as shown at 32 in FIG. 10. The median support 28 prevents the struts from becoming deformed during the use of the air gun. When the peening operation is completed, the median support is removed and the truss may be lifted out of the opposed dies 22, 23.

In the event that the desired length of the truss is longer than the number of struts 12 which can conveniently be slipped between the rails 10, 11, but not long enough to receive an additional strut, a makeup strut 33 of desired length such as is shown in FIG. 7 may be added. It will be seen that only one additional length strut will be needed to complete the truss assembly thereby greatly reducing the number of dies and operations required in providing necessary struts.

From the foregoing it will be seen that there has been provided a highly simplified truss structure which can be assembled by methods suitable for unskilled workers and by the use of a limited number of simple hand tools. The parts of the truss can be shipped in a knock-down position to a remote location and assembled as needed. The small number of parts required lends itself to economical fabrication and the light weight of the truss enables structures to be erected quickly using hand labor.

We claim:

1. The method of forming a structural truss having spaced elongated rails, an elongated track of substantially "C" shaped cross section on each of said rails, a plurality of rivets freely received within each of the tracks and a series of struts disposed between the spaced rails and carried by the rivets comprising the steps of bending the elongated rails to the desired truss shape, rigidly supporting the shaped rails in spaced relationship with their tracks in opposed position, slipping a plurality of rivets along the "C" shaped tracks with their shank portions extending outwardly of the tracks in the same direction, slipping a series of struts over the ends of the rivet shanks so that adjacent strut ends overlap upon the rivets, continuing to apply struts to the rivets in an angular zig-zag pattern until they traverse substantially the length of the truss and thereafter deforming the track adjacent the rivets to secure the rivets adjacent longitudinal displacement.

2. The method according to claim 1 in which the struts are releasably secured along an area intermediate the ends thereof after they are assembled upon the rivets and before the tracks are deformed.

3. The method according to claim 1 in which the rails are bent upon elongated spaced curved jigs and held thereon prior to the application of the struts.

4. The method according to claim 1 in which the tracks are deformed on each side of the rivet heads.

5. The method according to claim 1 in which the tracks are deformed by driving the links against the tracks in the area of the rivet heads.

6. A structural truss manufactured according to the process of claim 1.

* * * * *